US006193406B1

(12) United States Patent
Peltonen et al.

(10) Patent No.: US 6,193,406 B1
(45) Date of Patent: Feb. 27, 2001

(54) METHOD AND APPARATUS FOR MIXING PULP A SUSPENSION WITH A FLUID MEDIUM WITH A FREELY ROTATABLE MIXING ROTOR

(75) Inventors: Karl Peltonen; Reijo Vesala, both of Kotka (FI)

(73) Assignee: Andritz-Ahlstrom Oy, Espoo (FI)

( * ) Notice: Subject to any disclaimer, the term of this patent is extended or adjusted under 35 U.S.C. 154(b) by 0 days.

(21) Appl. No.: 09/194,358

(22) PCT Filed: May 29, 1997

(86) PCT No.: PCT/FI97/00325

§ 371 Date: Nov. 25, 1998

§ 102(e) Date: Nov. 25, 1998

(87) PCT Pub. No.: WO97/46309

PCT Pub. Date: Dec. 11, 1997

(30) Foreign Application Priority Data

Dec. 20, 1996 (FI) ..... 965137

(51) Int. Cl.[7] ..... B01F 7/04

(52) U.S. Cl. ..... 366/168.2; 366/171.1; 366/172.1; 366/280

(58) Field of Search ..... 366/168.1–168.2, 366/171.1, 172.1, 280, 306, 165.3, 172.2, 182.4, 182.1, 165.1, 165.2, 165.4, 174.1; 162/63–68

(56) References Cited

U.S. PATENT DOCUMENTS

| | | | | |
|---|---|---|---|---|
| 735,530 | | 8/1903 | Kühne . | |
| 1,636,127 | * | 7/1927 | Fickle . | |
| 4,030,969 | | 6/1977 | Asplund et al. . | |
| 4,093,506 | * | 6/1978 | Richter . | |
| 4,213,712 | * | 7/1980 | Aanonsen et al. | 366/178 |
| 4,333,748 | | 6/1982 | Erickson . | |
| 4,396,160 | * | 8/1983 | Rienecker et al. . | |
| 4,936,689 | * | 6/1990 | Federighi et al. | 366/337 |
| 5,258,100 | | 11/1993 | Niskanen et al. . | |
| 5,279,709 | * | 1/1994 | Niskanen . | |
| 5,466,334 | | 11/1995 | Fredriksson et al. . | |
| 5,492,409 | * | 2/1996 | Karlsson et al. | 366/338 |
| 5,556,200 | * | 9/1996 | Ekholm et al. | 366/175.2 |
| 5,564,827 | * | 10/1996 | Signer | 366/336 |
| 5,575,559 | * | 11/1996 | Roll | 366/171.1 |
| 5,791,778 | * | 8/1998 | Manninen et al. | 366/171.1 |

FOREIGN PATENT DOCUMENTS

| | | | |
|---|---|---|---|
| 0 664 150 | | 7/1995 | (EP) . |
| 1593918 | * | 7/1980 | (FR) . |
| 811 186 | | 4/1959 | (GB) . |
| 1 255 638 | | 12/1971 | (GB) . |
| 1255637 | * | 12/1971 | (GB) . |
| 778 741 | | 11/1980 | (SU) . |
| 93/07961 | * | 4/1993 | (WO) . |
| 95/10351 | * | 4/1995 | (WO) . |
| 96/32186 | * | 10/1996 | (WO) . |
| 96/33007 | * | 10/1996 | (WO) . |
| 97/01074 | * | 1/1997 | (WO) . |
| 99/43887 | * | 9/1999 | (WO) . |

* cited by examiner

*Primary Examiner*—W. L. Walker
*Assistant Examiner*—Marianne Ocampo
(74) *Attorney, Agent, or Firm*—Nixon & Vanderhye P.C.

(57) ABSTRACT

The present invention relates to a method and an apparatus for mixing a pulp suspension with a fluid medium. The method and the apparatus according to the invention are particularly advantageous when used for mixing different chemicals, both liquid and gaseous, or steam into pulp suspension in the wood processing industry. In the method and the apparatus according to the invention, the pulp suspension and the fluid medium are fed into a mixer casing, mixed therein and removed from the casing, and a freely rotatable mixing rotor with mixing blades, is placed within the casing and turned by means of incoming flow of pulp suspension being in contact with the mixing blades of the rotor.

10 Claims, 2 Drawing Sheets

METHOD AND APPARATUS FOR MIXING PULP A SUSPENSION WITH A FLUID MEDIUM WITH A FREELY ROTATABLE MIXING ROTOR

CROSS REFERENCE TO RELATED APPLICATION

This application is a U.S. National Phase of International Application No. PCT/F197/00325 filed May 29, 1997.

BACKGROUND AND SUMMARY OF THE INVENTION

The present invention relates to a method and apparatus for mixing a second medium with a first medium. The method and apparatus of the invention are especially suitable for mixing different chemicals, both fluid and gaseous ones, or steam with a so-called first medium, which is composed of both solid and fluid matter, like for example, cellulose fibre suspensions of the wood-processing industry or mixtures of, e.g., different beet chips (such as potato and sugar beet) and water.

Prior art mixers used for this purpose are disclosed, e.g., in U.S. Pat. Nos. 5,279,709 and 5,575,559 and in patent applications EP-A-92921912, EP-A-9100973, WO-A-96/32186, and WO-A-96/33007. It is a characteristic feature of all mixers of the art that they employ a rotatable rotor in order to provide a sufficient mixing efficiency. The rotatable rotor specifically refers to a member which is connected to the drive through a shaft and most usually receives its power from the electricity supply of the mill. Furthermore, the mixer construction is usually such that a certain pressure loss occurs in the mixer. In practice, it means that the power compensation corresponding to the pressure loss caused by the mixer has been taken into account when selecting a pump which operates at some stage of the process and precedes the mixer. So, in practice, power is lost in the pump for compensating the pressure loss of the mixer as well as in the mixer itself for rotating its rotor.

The method and apparatus in accordance with the invention eliminate one of the power-losing factors mentioned above. The rotor of the mixer is arranged to rotate freely in the flow, whereby the mixer naturally causes a certain pressure loss. However, a thorough research work has given such results that the pressure loss has not increased, at least not essentially, when compared with a motor-driven rotor. Furthermore, in spite of considerable power savings, no change in the mixing result can be found, at least not for the worse.

So-called static mixers are known in the art, but they are mostly of the type disclosed in, e.g., U.S. Pat. Nos. 4,030,969, 5,492,409, and 5,556,200, in which a throttling effect of some degree is arranged in the flow channel, whereby the flow rate increases and the pressure is reduced. The chemical or equivalent to be mixed is then conveyed to this lower-pressure zone, and the turbulence effect, also developed by throttling, then mixes the chemical or equivalent with the actual flow material. Another alternative is disclosed in, for example, U.S. Pat. Nos. 4,936,689 and 5,564,827, where the flow channel is provided with obstacles to flow so as to create turbulence. It is a characteristic feature of both types of mixers that the turbulence created is of local nature only and short in duration.

By the method and apparatus in accordance with the present invention, the kinetic energy originating from the pressure losses caused by the throttling device may be forwarded to the mixing zone in a more controlled manner and to a wider area, which will substantially grow the efficient mixing volume and substantially lengthen the mixing time.

It is a characteristic feature of the method in accordance with the invention of mixing a second medium with a first medium, in which method the first medium is introduced into a casing of a mixing apparatus, where it is mixed and discharged therefrom, that the rotor of the mixer disposed in the casing is rotated by a medium flow entering the casing.

It is a characteristic feature of the apparatus according to the invention, for mixing a second medium with a first medium, which apparatus comprises a mixer casing with an inlet and an outlet, both of these having a flange, and with a rotor, that the rotor is freely rotatable.

Other aspects characteristic of the method and apparatus of the invention will become apparent from the attached claims.

The method and apparatus in accordance with the invention are described more in detail below, by way of example, with reference to the enclosed drawings: in which

DETAILED DESCRIPTION OF THE DRAWINGS

Figure 1:
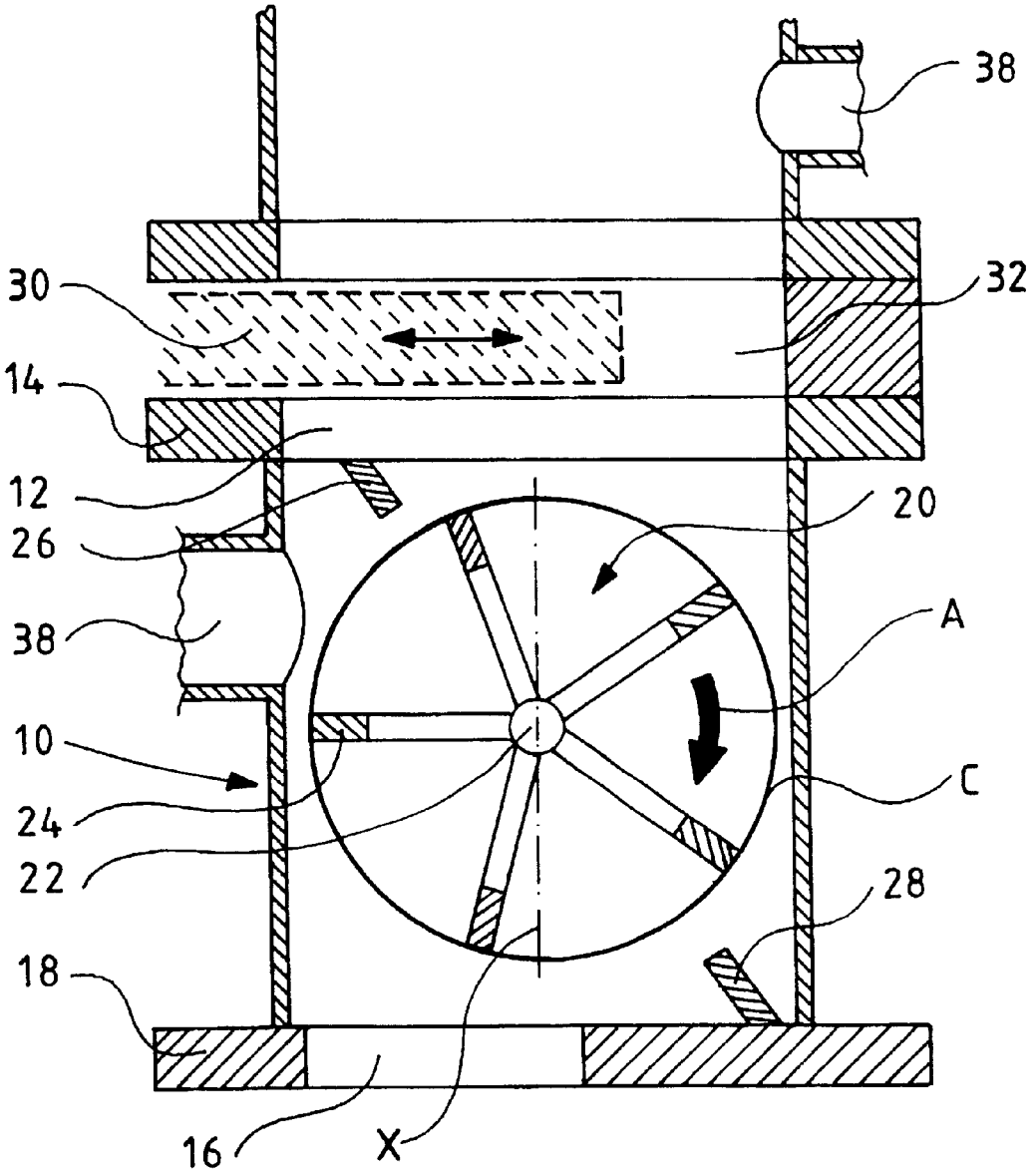
FIG. 1 is an axial section view of an apparatus in accordance with a preferred embodiment of the invention.

FIG. 1 shows an apparatus in accordance with a preferred embodiment, comprising a casing 10, which in its simplest form is cylindrical in the direction of flow of the medium, but it may also be cylindrical in the direction of the rotor shaft. The casing 10 of the mixer may also be of some other, more complicated shape, if such is considered reasonable. The casing 10 is provided with an inlet 12 and an outlet 16, with flanges 14 and 18 , respectively, the outlet being preferably tangential to the direction of rotation of the rotor, and with a rotor 20 arranged rotatably within the casing 10. The mixer is attached through its flange 14 to a so-called inlet piping, i.e., the flow channel of the incoming fiber suspension, and through its flange 18 to a so-called outlet piping, i.e. the flow channel of the fiber suspension being discharged from the mixer. The rotor 20 is formed of a shaft 22 mounted on bearings to a wall of the casing 10, the shaft being preferably perpendicular to the axis X of the casing 10. However, also other positions of the shaft 22 at different angles with respect to the axis X are feasible and, in some cases, even recommended. In fact, it is quite possible that the rotor shaft is congruent or at least parallel with the inlet axis. In that case, the rotor blades should be helical in order for the rotor to rotate. At least two blades 24 are attached to that end of the shaft 22 which extends to the inside of the casing 10, so that an open space remains in the center of the rotor 20 when the blades 24 rotate. The embodiment shown in FIG. 1 is provided with five blades 24, and they are substantially rectangular in cross section while the main shaft is radial. The most essential thing, with regard to the shape of the blades is, however, that it makes the rotor rotate and also brings about the desired mixing effect. The blades 24 extend preferably about 10 to 80 mm from the wall of the casing 10. The rotor 20 may be disposed in the casing 10 either centrally so that the distance of the circle of rotation C of the blades 24 from the wall of the casing 10 is equal on both sides of the rotor 20 or eccentrically so that the clearance between the circle of rotation C and the wall of the casing 10 is smaller on one side of the rotor 20 than on the other side. The rotor 20 or, more specifically, the rotor blades may be, e.g., such in shape that the shape of the surface of revolution is substantially spherical or cylindrical. Also other shapes of the surface of revolution are feasible as long as they are fitted together with the cross-sectional shape of the casing. The casing may also be provided with ribs 26 and 28 which, together with the rotor 20, cause a turbulence which brings about an adequate mixing effect in the suspension flow. The rib 26 is so arranged in connection with the inlet 12 that it directs the axial flow from the inlet 12 to the casing 10 of the mixer unevenly to the casing 10, thereby ensuring rotation of the rotor 20. In other words, besides a bevel guide member, as in FIG. 1, rib 26 may also be, e.g., a plate disposed perpendicularly to the axis of the flow path, covering part of the flow path. The most essential thing is that the member deviates the mass center of the flow from the axis of the flow channel.

The freely rotatable mixer shown in FIG. 1 is as such applicable for use with the heat exchanger illustrated in FIG. 6 of PCT/F196/00330, in which two heat exchangers are connected in series so that the tube between the heat exchangers is provided with a mixing member. According to our experiments, the mixer by no means needs to fluidize pulp; "stirring" is sufficient for thorough mixing of pulp particles with each other, no matter of what size they are at this stage. In any event, as a final result of mixing there is a pulp plug in a new order at the inlet of the heat exchanger, being distributed in a new manner onto the heat transfer surfaces of the latter heat exchanger. The mixer may be, e.g., an apparatus similar to the one shown in FIG. 1 or an apparatus where the mixing member is a circular or elliptic ring, which rotates freely in the flow under the effect of the flow. FIG. 1 further illustrates how the casing of the mixer may be provided with an auxiliary, i.e., a control valve 30, either as an integral part of the mixer or, alternatively, attached to the mixer flange 14. The control valve 30 shown in FIG. 1 is a conventional gate valve, but also other forms of valves are applicable. One task of the valve 30 is naturally to control the flow, whereby locating the rotor 20 near the valve 30 also contributes to the operation of the valve 30, ensuring that fibers cannot adhere to the gate or other valve member and thereby gradually cause the valve opening 32 to become clogged. Another task of the valve 30 is essential to the mixer, namely, it directs the flow in an eccentric form into the mixer casing 10. By ensuring that the flow entering the casing 10 is eccentric, especially respective of the rotor shaft, one may be sure that the rotor 20 rotates in all circumstances in the direction of arrow A.

FIG. 1 also illustrates how either the mixer casing 10 or the inlet piping may be provided with a conduit 38, 38' for adding a chemical, dilution liquid, steam, or other material to the flow. The valve potentially attached to the flange 14 of the casing 10 can be considered part of said inlet piping. Location of a chemical feed conduit is chosen optimally in accordance with both the mixer operation and the medium to be mixed. For example, when liquid is fed, it is advantageous to direct the incoming liquid jet in the direction of rotation of the rotor in order not to decelerate rotation. Correspondingly, the inlet conduit for gas is preferably disposed in the lower section of the casing and the outlet in the upper section thereof in order for the gas flow from the inlet to the outlet to proceed reliably. In the above described example, where mixing was used only for equalization of temperature differences in pulp, such a conduit is naturally unnecessary. It has to be noted that preferably the mixing conduit 38 has to be located far enough from the outlet 16 of the casing 10 of the mixer so that the chemical or equivalent has an adequate time to mix well enough with the pulp prior to being discharged from the mixer. It could be a guideline that the mixing conduit 38 should be disposed against the direction of rotation of the rotor at the distance of at least 90 degrees, preferably 180 degrees, from outlet 16. Naturally, it has to be noted that the medium to be mixed also sets its own limits to the location of the mixing conduit.

Figure 2:
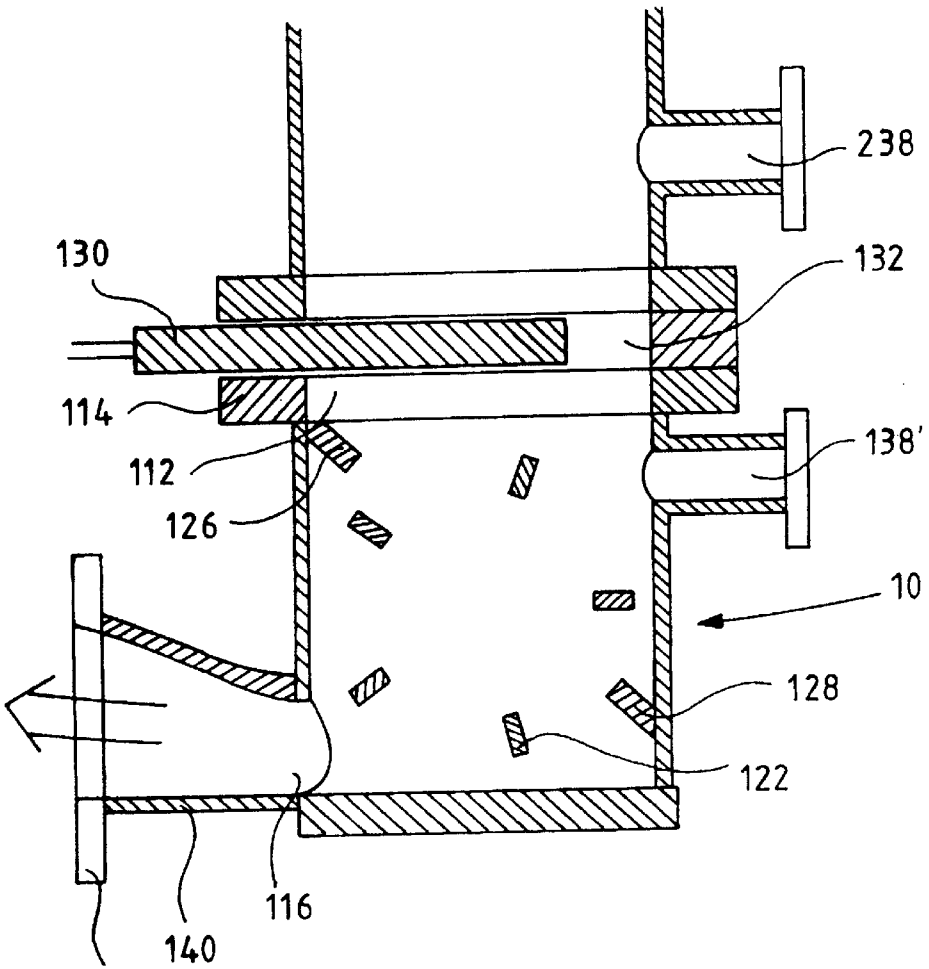
FIG. 2 is an axial section view of an apparatus in accordance with a second preferred embodiment of the invention.

FIG. 2 illustrates a mixing apparatus in accordance with a second preferred embodiment. The same reference numerals as in FIG. 1 have been used where applicable, except that all reference numerals of FIG. 2 start with number 1. In fact, there are not many differences in comparison with the embodiment shown in FIG. 1. In the embodiment of FIG. 2, a valve 130 is illustrated as a member which is clearly separate from the casing 10 of the mixer, which member is attached to a flange 114 of the casing. Another difference is to locate the outlet 116 of the casing 10 at an angle of 90 degrees, or if a widening of the outlet is taken into account, at an angle of approximately 100 degrees with respect to the inlet piping. Furthermore, the outlet 116 is provided with an outlet pipe 140 which widens preferably in the direction of flow just like a diffuser pipe. The purpose of the widening of the outlet duct 140 is to recover dynamic pressure from the flow being discharged from the casing of the mixer.

Figure 3:
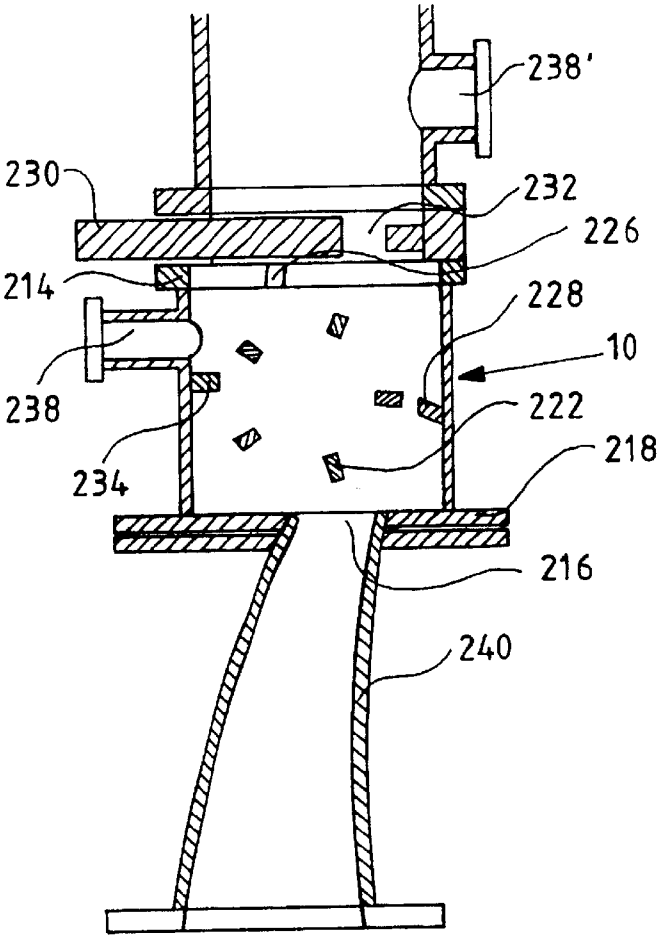
FIG. 3 is an axial section view of an apparatus in accordance with a third preferred embodiment of the invention.

FIG. 3 shows a mixing apparatus in accordance with a third preferred embodiment. The same reference numerals as in FIG. 1 have been used where applicable, except that all reference numerals of FIG. 3 start with number 2. In the embodiment of FIG. 3, the outlet 216 of the mixer is disposed opposite to the inlet 212 of the mixer. Further, the outlet 216 is provided with an outlet pipe 240, as in FIG. 2. Unlike the outlet pipe 140 of FIG. 2, which is an integral part of the mixer casing 10, the outlet pipe 240 of FIG. 3 is attached to the flange 218 of the outlet 216 of the casing 10. Naturally, the location and way of attachment of the outlet pipe are not dependent on each other, but a detachable outlet pipe may be disposed also in a mixer discharged from its side as in FIG. 2, and a stationary outlet pipe also in an arrangement as shown in FIG. 3.

The apparatus according to the preferred embodiments of the invention described above functions so that throttling, effected by either a valve or a rib, on the inlet side of the mixer controls the velocity of the fiber suspension jet entering the mixer, to be preferably in the range of 5 to 30 m/s, more preferably in the range of 10 to 20 m/s. The combination of the flow being deviated from the central flow direction and said flow velocity makes the rotor 20 arranged in the casing 10 rotate. When operating, the mixer causes a pressure loss of the order of 0.5 to 3.5 bar, preferably 0.5 to 2.5 bar, most of the pressure loss being caused by throttling arranged at the inlet of the mixer by means of a valve or a rib 26. In other words, the pressure loss is controllable, by adjusting the inlet side throttling. On the other hand, the total pressure loss caused by the mixer may be reduced by shaping the outlet pipe of the outlet side of the mixer optimal, i.e., such that it will recover part of the dynamic pressure.

As can be seen from the few exemplary, preferred embodiments described above, a totally new type of mixer has been developed which is advantageous in terms of economy. Although use of the method and apparatus have been presented hereinabove very generally in mixing of a fiber suspension, they are well applicable up to a consistency of 15%. On the other hand, speaking of fiber suspensions may appear restricted; so, it is worth mentioning that the mixer in accordance with the invention may correspondingly be used, e.g., in various applications of the food industry, for treating mixtures of solid materials and liquids, for example, in treatment of beet chips.

What is claimed is:

1. A method of mixing a pulp suspension with a fluid medium, comprising liquid or gaseous chemicals or steam, in a mixer comprising a casing and a mixing rotor having mixing blades within the casing, comprising:

(a) introducing the pulp suspension and the fluid medium into the casing;

(b) effecting mixing of the pulp and the fluid medium by causing the mixing rotor to be rotated by the flow of the pulp into contact with the mixing blades of the mixing rotor; and (c) discharging the pulp mixed with fluid medium from the casing.

2. A method as recited in claim 1 wherein (b) is practiced by throttling the pulp flow to the casing so as to control the flow rate so as to make the flow rate more suitable for effecting rotation of the mixing rotor.

3. A method as recited in claim 2 wherein (b) is practiced so that the velocity of the pulp flow entering the casing after throttling is 10 to 20 m/s.

4. A method as recited in claim 1 further comprising (d) throttling the pulp flow to the casing so as to achieve a desired pressure differential.

5. A method as recited in claim 4 wherein (d) is practiced so that the pressure differential is within the range of 0.5 to 2.5 bar.

6. A method as recited in claim 1 wherein (a) is practiced by introducing the fluid medium upstream of the mixing rotor, into an inlet piping preceding the casing.

7. A method as recited in claim 1 wherein the rotor is rotatable about an axis of rotation disposed substantially centrally in the casing; and wherein (b) is practiced by introducing the pulp suspension into the casing so that the mass center of the pulp is offcenter of the axis of rotation of the mixing rotor.

8. A method as recited in claim 1 further comprising recovering dynamic pressure from the pulp suspension mixed with the fluid medium discharged in (c).

9. A method as recited in claim 1 wherein (a) is practiced by introducing as the fluid medium a fluid selected from steam, water, oxygen, chlorine dioxide, and combinations thereof.

10. A method as recited in claim 1 wherein (b) is practiced by using the mixing rotor to create turbulence.

* * * * *